US008201632B2

(12) United States Patent
Burnett

(10) Patent No.: US 8,201,632 B2
(45) Date of Patent: Jun. 19, 2012

(54) DOWNHOLE VALVE ASSEMBLY AND ACTUATION DEVICE FOR A DOWNHOLE VALVE ASSEMBLY

(75) Inventor: William S. Burnett, Aberdeen (GB)

(73) Assignee: Red Spider Technology Limited, Westhill, Aberdeen (GB)

( * ) Notice: Subject to any disclaimer, the term of this patent is extended or adjusted under 35 U.S.C. 154(b) by 178 days.

(21) Appl. No.: 12/220,533

(22) Filed: Jul. 25, 2008

(65) Prior Publication Data

US 2009/0065213 A1 Mar. 12, 2009

(30) Foreign Application Priority Data

Jul. 27, 2007 (GB) ..... 0714614.5

(51) Int. Cl.
*E21B 34/10* (2006.01)
*E21B 34/14* (2006.01)
*F16K 5/06* (2006.01)

(52) U.S. Cl. ... 166/321; 166/319; 166/373; 251/315.02; 251/315.03

(58) Field of Classification Search ..... 166/319, 166/321, 373, 250.07; 251/315.02, 315.03, 251/315.16; 137/318, 494
See application file for complete search history.

(56) References Cited

U.S. PATENT DOCUMENTS

| | | | | |
|---|---|---|---|---|
| 3,463,449 | A * | 8/1969 | Eilers et al. | 251/309 |
| 3,509,913 | A | 5/1970 | Lewis | |
| 3,826,281 | A * | 7/1974 | Clark | 137/625.31 |
| 3,896,876 | A | 7/1975 | Crowe | |
| 4,467,870 | A * | 8/1984 | Langham | 166/321 |
| 2002/0121373 | A1 | 9/2002 | Patel | |
| 2008/0110632 | A1 * | 5/2008 | Beall | 166/332.3 |
| 2008/0196898 | A1 * | 8/2008 | Jasser et al. | 166/319 |

FOREIGN PATENT DOCUMENTS

WO 2007/049046 A1 5/2007

OTHER PUBLICATIONS

U.K. Search Report.

* cited by examiner

*Primary Examiner* — David J. Bagnell
*Assistant Examiner* — Catherine Loikith
(74) *Attorney, Agent, or Firm* — Ladas & Parry LLP

(57) ABSTRACT

A downhole valve assembly including a valve mounted in a tubular body, the valve moveable between an open and closed position. Movement is achieved by a fluid operated valve actuation mechanism located downhole of the valve having a fluid inlet port located uphole of the valve. A method of controlling fluid flow downhole is also described allowing the valve to be moved between the open and closed positions and between closed and open positions.

13 Claims, 13 Drawing Sheets

DOWNHOLE VALVE ASSEMBLY AND ACTUATION DEVICE FOR A DOWNHOLE VALVE ASSEMBLY

The present invention relates to a downhole valve assembly, an actuation device for a downhole valve assembly, and to a method of controlling fluid flow downhole. In particular, but not exclusively, the present invention relates to a downhole valve assembly having a generally tubular body defining a fluid flow path therethrough and having a valve mounted in the body for controlling fluid flow through the fluid flow path; to an actuation device for such a downhole valve assembly; and to a corresponding method of controlling fluid flow downhole.

As is well known in the oil and gas exploration and production industry, a wellbore or borehole is drilled from surface in order to gain access to subterranean hydrocarbon deposits (oil and gas). The wellbore is typically drilled to a first depth and then lined with a steel casing which is cemented in place, both to support the drilled rock formations, and to prevent unwanted fluid ingress/egress. The wellbore is then extended to a further depth and a smaller diameter casing is located in the extended section, passing through the wellbore to surface, and which is also cemented in place. This process is repeated as necessary until the wellbore has been extended to a desired depth. If required, a liner may be located in the final drilled section, the liner tied in to the deepest section of casing in the wellbore. The well is then completed, which involves carrying out various downhole procedures so that well fluids can be recovered to surface through production tubing located in the cased wellbore.

During completion of the wellbore, it is necessary to test the integrity of the casing/liner located in the wellbore, to ensure a pressure-tight seal has been obtained. This is achieved by running-in a tubing string carrying a downhole valve assembly, and locating and sealing the valve assembly in the casing/liner. The valve assembly typically includes a ball valve which is initially in an open position that permits fluid flow and tool passage along a body of the valve assembly, and thus enables further completion procedures to be carried out. Once the further procedures have been carried out, the valve is actuated to move the ball valve to a closed position.

In the closed position, the ball valve prevents further fluid flow/tool passage along the body flow path, and thus effectively isolates a portion of the wellbore below the valve from the portion above. A pressure-test can then be carried out, to verify the integrity of the casing/liner above the valve. Following completion of the pressure test, the valve can be actuated to move the ball valve back to the open position, enabling further downhole operations to be carried out.

The ball valves of existing downhole valve assemblies are typically mounted in ball cages which are translated axially relative to the body of the valve in order to move the ball valve between its open and closed positions. The valve assemblies are actuated to move the ball valves between their open and closed positions using applied fluid pressure, which is communicated to an actuation mechanism of the assembly. The actuation mechanisms are usually provided adjacent to and/or immediately uphole of the ball valve itself.

Providing valve assemblies in which the ball valve and ball cage are translated axially between open and closed positions can present problems in use of the valve assemblies. In particular, solids debris particles present in the wellbore have a tendency to settle out over time. Accordingly, when the valve assembly has been actuated to move the ball valve to a closed position, the solids debris tends to settle on the ball valve itself, and can build up into a deposit of significant depth. As a result, the ball valve can become jammed and incapable of the axial translation necessary to move the ball valve between its open and closed positions. Furthermore, the solids deposit can also cause the actuation mechanism to become blocked or jammed.

Consequently, the ball valve can become jammed closed, requiring remedial action to be taken to reopen the wellbore, which may include milling or drilling out the jammed ball valve. Such procedures are costly to carry out; result in serious damage to the valve assembly; produce large volumes of swarf which requires to be circulated out of the wellbore before well operations can resume; and results in a costly suspension of well operations.

It is therefore amongst the objects of at least one embodiment of the present invention to obviate or mitigate at least one of the foregoing disadvantages.

According to a first aspect of the present invention, there is provided a downhole valve assembly comprising:

- a generally tubular body defining a fluid flow path therethrough;
- a valve mounted within the body, the valve movable between an open position and a closed position for thereby controlling the flow of fluid along the fluid flow path;
- a valve actuation mechanism mounted within the body, the actuation mechanism located in a position which is, in use, downhole of the valve; and
- a fluid communication arrangement for communicating fluid pressure to the valve actuation mechanism to facilitate operation of the valve actuation mechanism and thereby operation of the valve, the fluid communication arrangement comprising a fluid inlet port which is, in use, located uphole of the valve.

Providing a downhole valve assembly with a valve and a valve actuation mechanism located downhole of the valve offers significant advantages over prior valve assemblies. This is because, in the event that solids present in fluid in a wellbore settle on the valve when the valve is closed, these solids cannot cause the actuation mechanism to become jammed or stuck, and therefore cannot affect actuation of the valve. Furthermore, providing such a valve assembly in which the fluid inlet port is provided uphole of the valve still permits control of and actuation of the valve in response to fluid pressure or fluid communication from uphole of the valve.

The actuation mechanism may be adapted to exert a force on the valve to move the valve between the open and closed positions in response to an applied fluid pressure. In a preferred embodiment, the actuation mechanism is arranged to exert a force on the valve to move the valve from the closed position to the open position.

The actuation mechanism may comprise a force transmission arrangement for transmitting a force to the valve to move the valve between the open and closed positions, preferably for moving the valve from the closed position to an open position. The force transmission arrangement may comprise an actuating member and a coupling member, the actuating member connected to the coupling member and the coupling member connected to the valve, to facilitate transmission of a force from the actuating member to the valve.

The actuating member may be connected to the coupling member via a connector which facilitates limited axial movement of the coupling member relative to the actuating member. This may facilitate movement of the valve between the open and closed positions, preferably from the closed position to the open position, by application of an external force.

The connector may permit a limited movement of the coupling member relative to the actuating member in a direction towards the valve which may, in use, be an uphole direction.

The actuating member may be selectively restrained against axial movement relative to the body, and may be biased for movement in a direction away from the valve which may, in use, be a downhole direction.

The actuating member may be selectively restrained by a locking arrangement and may, when the locking arrangement is actuated, be released for movement under a biasing force in the direction away from the valve. Such movement may carry the coupling the member and may thereby move the valve from the closed position to the open position.

The locking arrangement may comprise an at least one lock member adapted to restrain the actuating member against movement relative to the body, and at least one release member adapted to exert a release force on an or each lock member, to cause the or each lock member to release the actuating member for movement relative to the body. The locking arrangement may further comprise an at least one locking dog, key, button or the like, the or each dog movable from a release position out of engagement with the actuating member to a locking position in engagement with the actuating member, for restraining the actuating member against movement relative to the body. The or each locking dog may be adapted to co-operate with the lock member and may be supported in engagement with the actuating member by the lock member when in the locking position. The release member may be adapted to be actuated to move the lock member and desupport the locking dog in response to an applied fluid pressure.

The actuation mechanism may include a pressure sensor for measuring pressure in a wellbore in which the assembly is located, and means for setting a reference pressure value using a measurement obtained by the pressure sensor. In this fashion, when pressure applied to the assembly meets a predetermined condition, such as falling within a pressure window for a certain time period, the actuation mechanism may be actuated to move the valve. This method of operating the actuating mechanism is disclosed in detail in the Applicant's International Patent Publication Number WO 2007/049046, the disclosure of which is incorporated herein by way of reference.

The actuation mechanism may take the form of a primary valve actuation mechanism, and the assembly may further comprise a secondary valve actuation mechanism. The secondary actuation mechanism may comprise a fluid actuated override member, which may take the form of an override piston. The override member may be located, in use, downhole of the valve and adapted to exert a force on the valve for moving the valve between the open and closed positions, preferably from the closed position to the open position. Providing the override member downhole of the valve prevents blockage and jamming of the override piston through build-up of solids, and provides an emergency override for actuating the valve, preferably for opening the valve.

The override member may be adapted to exert a force on the coupling member of the primary actuation mechanism, for moving the valve.

The secondary actuation mechanism may further comprise an operating member which may take the form of a sliding sleeve provided, in use, uphole of the valve. The operating member may be fluidly coupled to the override member and may serve for controlling movement of the override member. The operating member may be mounted for movement within the body, movement of the operating member pumping fluid to the override member to thereby move the valve. The operating member may be adapted to be moved to pump fluid to the override member by a downhole tool run into the assembly and engaged with the operating member, which downhole tool may be a stinger or the like.

Preferably, the valve is a ball valve and is mounted for rotation relative to the body, to facilitate movement of the valve between its open and closed positions. The ball valve may be secured against axial movement relative to the body, which may be achieved by journalling or otherwise rotatably mounting the ball valve to the body. In a particular embodiment, the ball valve may comprise trunnions or other mounting members for mounting the ball valve to the body, the trunnions extending through a ball cage, the ball cage adapted to co-operate with the ball valve for moving the ball valve between the open and closed positions. Where the actuation mechanism comprises a coupling member, the coupling member may be coupled to the ball cage.

The ball valve may comprise a surface defining at least one recess therein, the recess adapted to define a guide for guiding a cutting tool into contact with the ball valve, a wall thickness of the ball valve in a region adjacent a base or root of the recess being smaller than a wall thickness of the ball valve laterally spaced from the base. Providing such a recess facilitates cutting of the ball valve in the event that the valve becomes stuck or jammed in the closed position, and thus facilitates reopening of a wellbore in which the assembly is located in the event that the ball valve becomes jammed closed. It will be understood that the cutting tool may be a drill, mill or other abrading/abrasive tool.

The surface of the ball valve carrying the recess may be adapted to face uphole, in use, when the ball valve is in the closed position. The recess may be circular, and at least one side wall of the recess may be inclined relative to an axis of the ball valve which is parallel to a main axis of the body when the ball valve is in the closed position. This may facilitate guiding of a cutting tool such as an annular milling tool, having cutting elements on a leading edge thereof, into engagement with the ball valve.

The ball valve may comprise at least one further recess, and the at least one further recess may be disposed on an axis of the ball valve which is parallel to the main axis of the body when the ball valve is in the closed position. The further recess may facilitate guiding of a drill bit into engagement with the ball valve.

The or each recess of the ball valve may be at least partly filled with a material having a lower hardness in comparison to a material of a main part/remainder of the ball valve. Filling the or each recess with such a material prevents blockage of the recess through solids settlement, but is easily milled or cut out should it prove necessary to drill out the ball valve. The material may be a softer metal, an elastomeric material or a plastics material.

According to a second aspect of the present invention, there is provided an actuation device for a downhole valve assembly, the actuation device comprising:

- a valve actuation mechanism adapted to be mounted in a generally tubular body of a downhole valve assembly in a position which is, in use, downhole of a valve mounted within the body of the downhole valve assembly; and
- a fluid communication arrangement for communicating fluid pressure to the valve actuation mechanism to facilitate operation of the valve actuation mechanism and thereby operation of the valve, the fluid communication arrangement comprising a fluid inlet port which is adapted, in use, to be located uphole of the valve.

Further features of the actuation device are defined above in relation to the first aspect of the present invention.

According to a third aspect of the present invention, there is provided a method of controlling fluid flow downhole, the method comprising the steps of:

locating a downhole valve assembly in a wellbore;

directing fluid in the wellbore into a fluid flow path extending through a generally tubular body of the assembly;

arranging a valve of the assembly mounted within the body in one of an open position and a closed position; and applying fluid pressure to a valve actuation mechanism of the assembly located downhole of the valve using a fluid communication arrangement of the assembly, the fluid pressure applied through a fluid inlet port of the arrangement located uphole of the valve, to operate the actuation mechanism and thereby move the valve to the other one of the open position and the closed position so as to control the flow of fluid along the fluid flow path.

The method may comprise the step of running the downhole valve assembly into the wellbore with the valve of the assembly in an open position, and then locating the assembly downhole with the valve in the open position. The valve may then be moved to a closed position, which may be achieved using a downhole tool such as a stinger, the downhole tool adapted to exert a force on the valve to move the valve to the closed position. Following closing of the valve, further downhole procedures may be carried out. Such procedures may comprise pressure testing the integrity of downhole tubing such as a casing and/or liner in which the assembly is located.

On completion of further downhole procedures, the valve may be returned to an open position. This may be achieved by the step of applying fluid pressure to the valve actuation mechanism, which may exert a force on the valve to move the valve back to the open position. The step of applying fluid pressure to the actuation mechanism may comprise pressurising fluid in the wellbore above the valve to a pressure which is within a determined pressure window, and/or applying pressure for a determined time period, in response to which the actuation mechanism may be activated to thereby move the valve to the open position.

According to a fourth aspect of the present invention, there is provided a ball valve comprising:

a valve element having a bore extending therethrough, the valve element adapted to be mounted within a generally hollow body and being rotatable between an open position in which the valve element permits fluid flow along the body through the bore of the valve element and a closed position in which the valve element prevents fluid flow along the body; wherein the valve element comprises a surface defining at least one recess adapted to define a guide for guiding a cutting tool into contact with the valve element, to facilitate cutting of the valve element in the event that the valve element becomes stuck in the closed position.

Preferably, the ball valve is a ball valve for a downhole valve assembly. However, the ball valve may have a utility with other types of valve assembly.

Further features of the ball valve are defined above in relation to the first aspect of the present invention.

Embodiments of the present invention will now be described, by way of example only, with reference to the accompanying drawings, in which.

Figure 1:
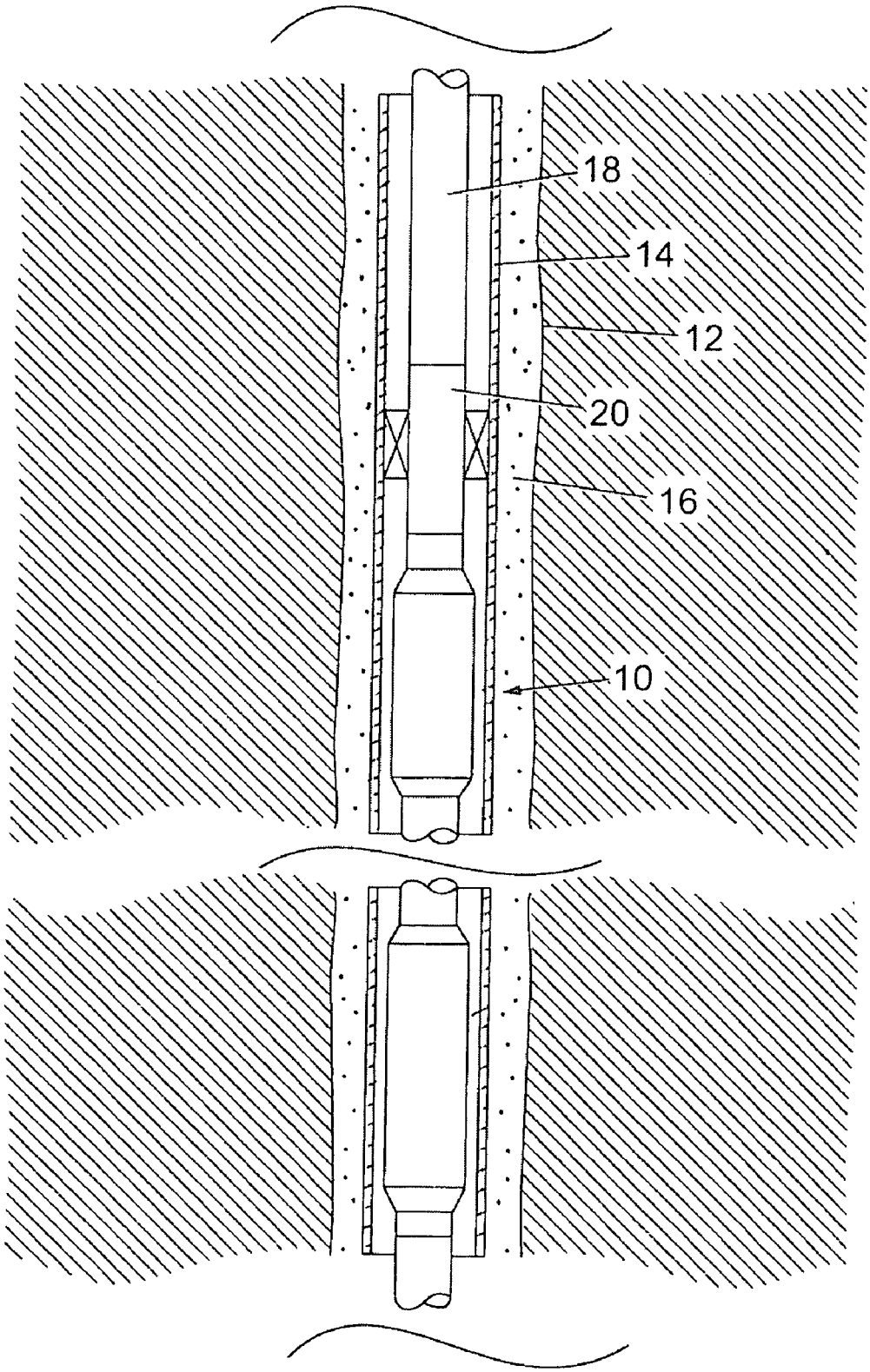
FIG. 1 is a schematic, partial longitudinal sectional view of a downhole valve assembly in accordance with an embodiment of the present invention, the valve assembly shown located in a wellbore and with tubing coupled to the assembly.
Figure 2:
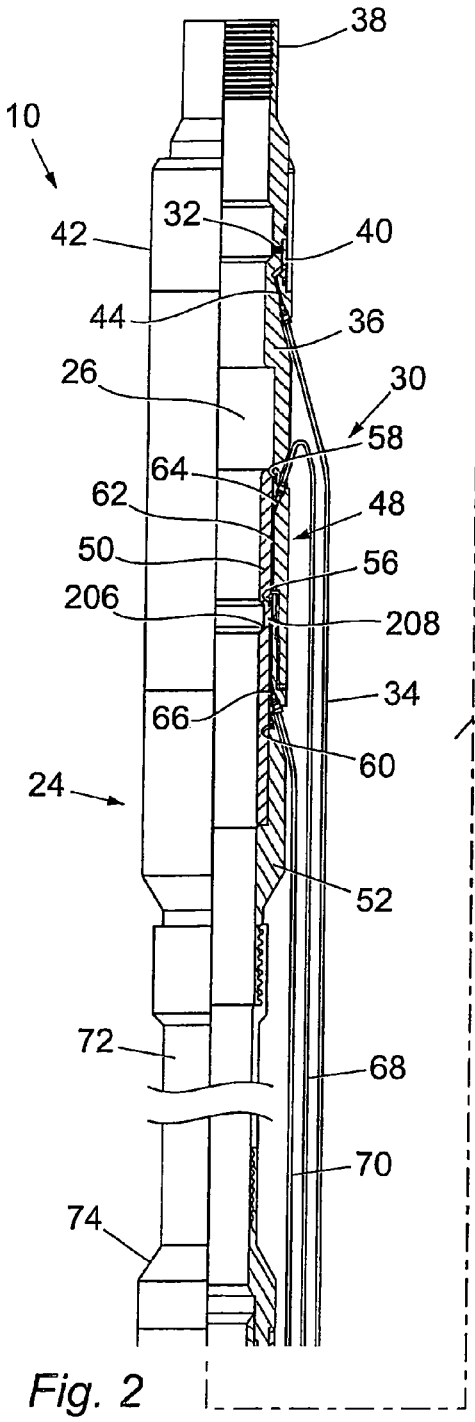
FIGS. 2 to 5 are detailed, longitudinal half-sectional views of the valve assembly shown in FIG. 1, taken from top to bottom and shown in a run-in-hole configuration with a valve of the assembly in an open position.

Turning firstly to FIG. 1, there is shown a schematic, partial longitudinal sectional view of a downhole valve assembly in accordance with an embodiment of the present invention, the valve assembly indicated generally by reference numeral 10. The valve assembly 10 is shown located in a wellbore 12 which has been lined with a casing 14 that has been cemented in place using cement 16, in a fashion known in the art. The valve assembly 10 is run-in to the wellbore 12 on a tubing string 18 and has been located in the casing 14 using a hanger/packer tool assembly 20, in a fashion again known in the art.

The valve assembly 10 is shown in more detail in the longitudinal half-sectional views of FIGS. 2 to 5, which are taken from top to bottom and show the valve assembly in a run-in-hole configuration, in which a valve in the form of a ball valve 22 of the assembly 10 is in an open position. The valve assembly 10 includes a generally tubular body 24 defining a fluid flow path 26 therethrough. The ball valve 22 is mounted within the body 24 and is movable between the open position, shown in FIG. 3, and a closed position which will be shown and described below, for thereby controlling the flow of fluid along the fluid flow path 26. The valve assembly 10 also includes a valve actuation mechanism 28 mounted within the body 24, and the actuation mechanism 28 is located in a position which is, in use, downhole of the ball valve 22. The valve assembly 10 also includes a fluid communication arrangement 30 for communicating fluid pressure to the actuation mechanism 28, to facilitate operation of the actuation mechanism, in order to control operation of the ball valve 22. The fluid communication arrangement 30 includes a fluid inlet port 32 which is, in use, located uphole of the ball valve 22.

In general terms, the valve assembly 10 is operated as follows. The valve assembly 10 is run-in to the wellbore 12 in the run-in configuration shown in FIGS. 2 to 5, and thus with the ball valve 22 in the open position of FIG. 3. Following location of the valve assembly 10 in the casing 14 using the hanger/packer tool assembly 20, further downhole operations may be conducted. These may include flowing fluid down through the fluid flow path 26 and thus through the open ball valve 22 for carrying out a downhole operation below the valve assembly 10, or indeed the passage of further tools along the flow path 26 and through the ball valve 22. Such procedures may in particular form part of a completion operation in which the wellbore 12 is prepared for production of wellbore fluids (oil and gas).

Following completion of the wellbore 12, the tubing string 18 may be disconnected from the hanger/packer tool assembly 20 and returned to surface, and the valve assembly 10 actuated to close the ball valve 22. A pressure-test operation is then carried out to test the integrity of the casing 14, to ensure no leak paths exist for the ingress or egress of fluid into or out of the casing 14. The valve assembly 10 therefore effectively closes and seals the wellbore 12 at a level below the ball valve 22, and the pressure of fluid in the casing 14 above the ball valve may then be raised and monitored for a desired time period. Any leak paths present will cause a reduction in the pressure of fluid in the casing 14 which can be detected at surface, providing an indication that remedial action is required before production of wellbore fluids can commence.

On completion of a successful pressure-test operation, the valve assembly 10 may be actuated to reopen the ball valve 22. This is achieved by communicating a fluid pressure signal to the actuation mechanism 28 using the fluid communication arrangement 30. Specifically, fluid pressure is communicated to the actuation mechanism 28 through the fluid inlet port 32 and a primary control line 34, which is shown schematically in FIGS. 2 to 5. Following the teachings of the Applicant's International Patent Publication Number WO 2007/049046, the disclosure of which is incorporated herein by way of reference, when the applied pressure meets a pre-determined condition, such as falling within a determined pressure window for a specified time period, the actuation mechanism 28 is activated to move the ball valve 22 from a closed position back to the open position of FIG. 3, in which the fluid flow path 26 is once again open.

By providing the actuation mechanism 28 downhole of the ball valve 22, any solids present in fluid in the casing 14, which would tend to settle on the ball valve 22 following closure, are prevented from falling further downhole beyond the ball valve 22. Accordingly, these solids cannot hamper actuation of the mechanism 28. Furthermore, by providing the fluid communication arrangement 30 with an inlet port 32 uphole of the ball valve 22, the pressure of fluid in the casing 14 above the ball valve 22 can be communicated to the actuation mechanism 28 to selectively actuate the ball valve 22. The fluid inlet port 32 is spaced a sufficient distance from the ball valve 22 such that, in the event of solids build-up on the closed ball valve 22, the solids will not block the port 32 and restrict operation of the valve assembly 10.

The valve assembly 10 will now be described in more detail.

Viewing generally from top to bottom in FIGS. 2 to 5, the valve assembly 10 includes the following components. The body 24 is made up from a number of connected tubing sections or subs, and an upper sub 36 carries a female (box) connector 38 for connecting the valve assembly 10 to the hanger/packer tool assembly 20, or indeed to other downhole tools or tubing. The fluid inlet port 32 extends through a wall of the upper sub 36 and communicates with an annular chamber 40 defined between the upper sub 36 and a sleeve 42 which is threaded to the upper sub 36. A passage 44 opens on to the chamber 40 and is in fluid communication with the primary control line 34. The control line 34 itself extends from the upper sub 36 to a lower end 46 of the assembly 10, for connection to the actuation mechanism 28.

Figure 3:
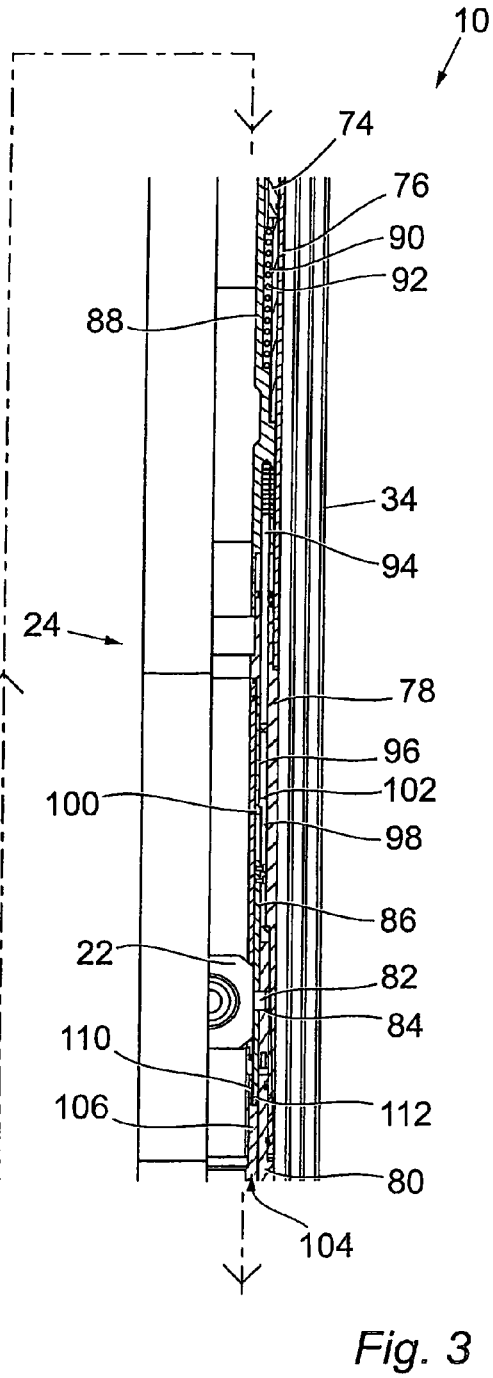
Figure 4:
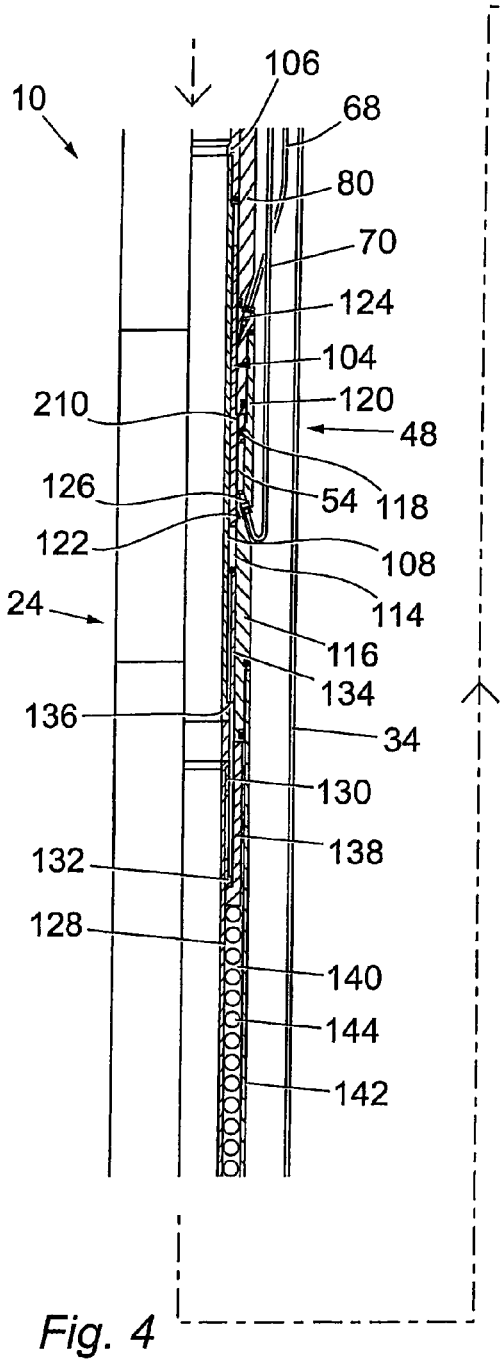
Figure 5:
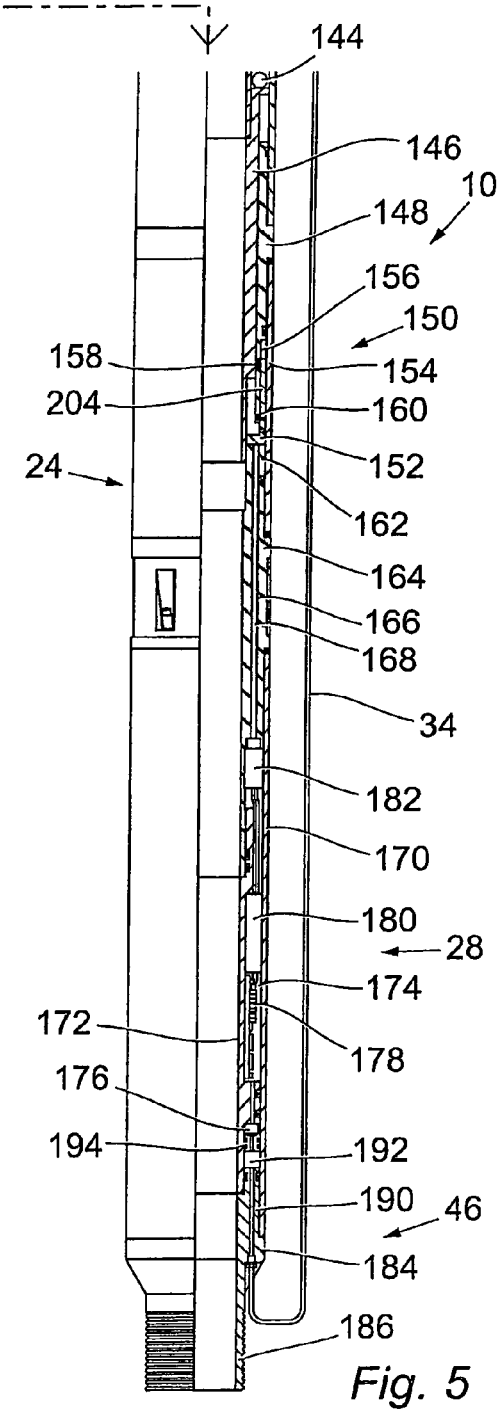
Figure 6:
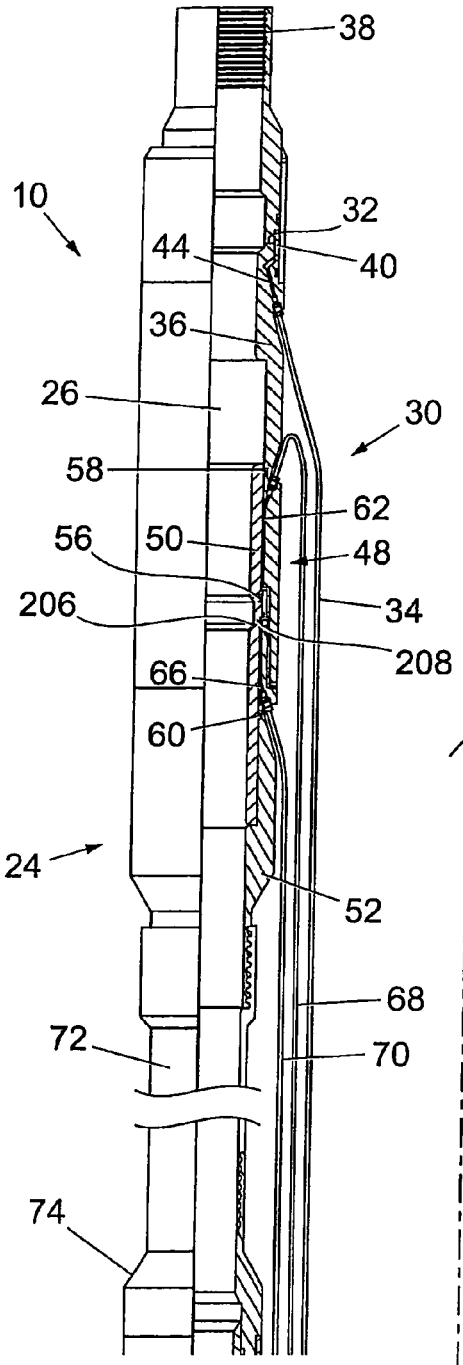
FIGS. 6 to 9 are views of the valve assembly of FIGS. 2 to 5 following closure of the valve using an external tool.
Figure 7:
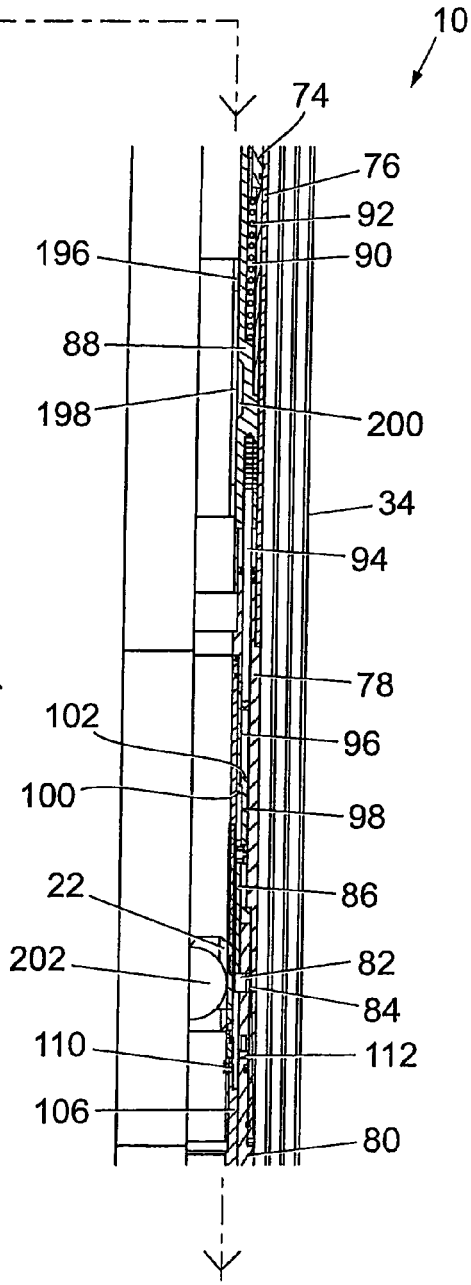
Figure 8:
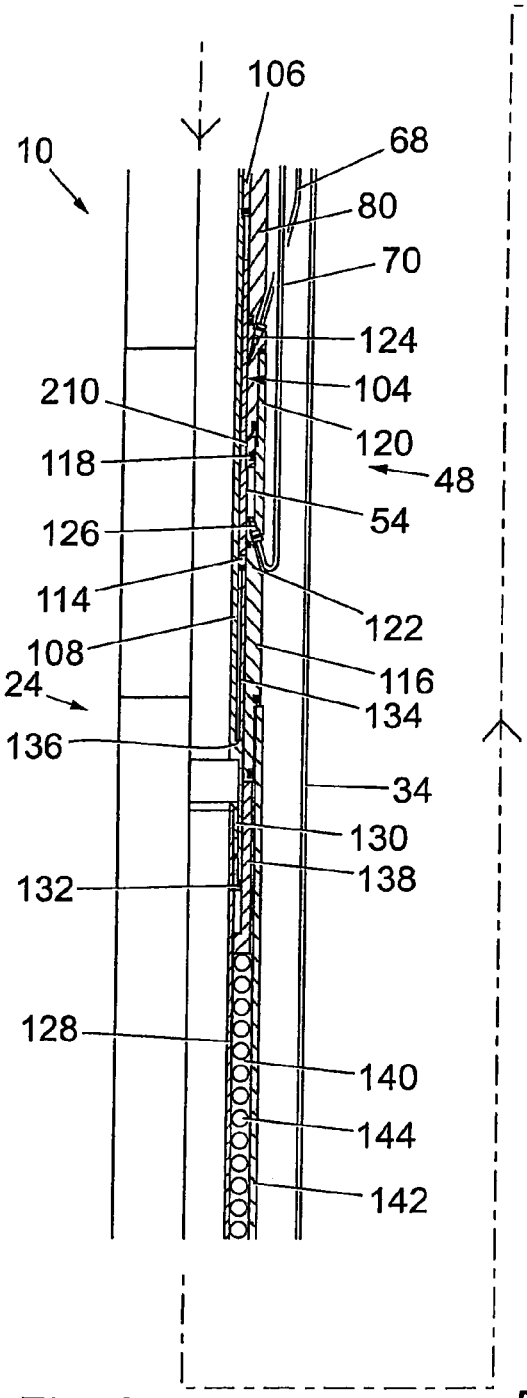
Figure 9:
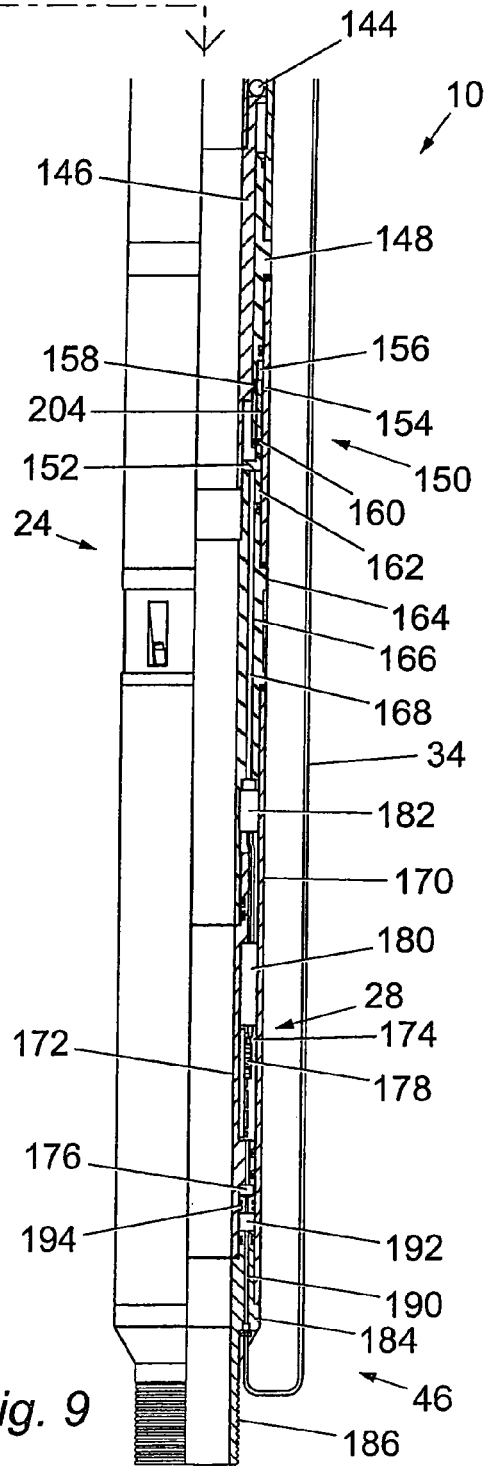
Figure 10:
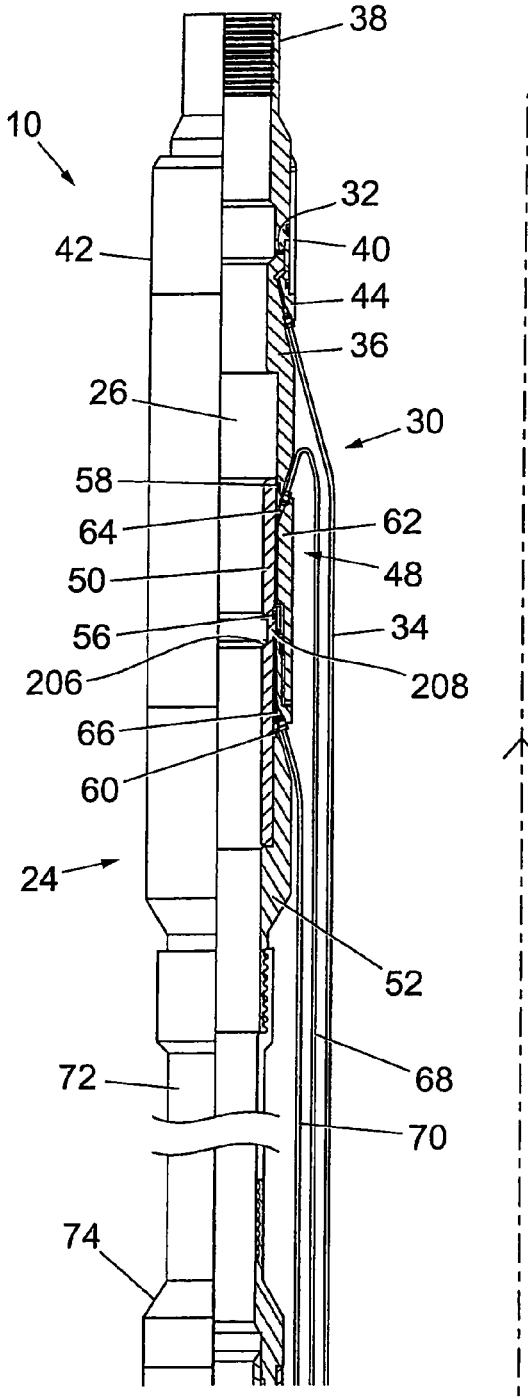
FIGS. 10 to 13 are views of the valve assembly of FIGS. 2 to 5 following removal of the external tool.
Figure 11:
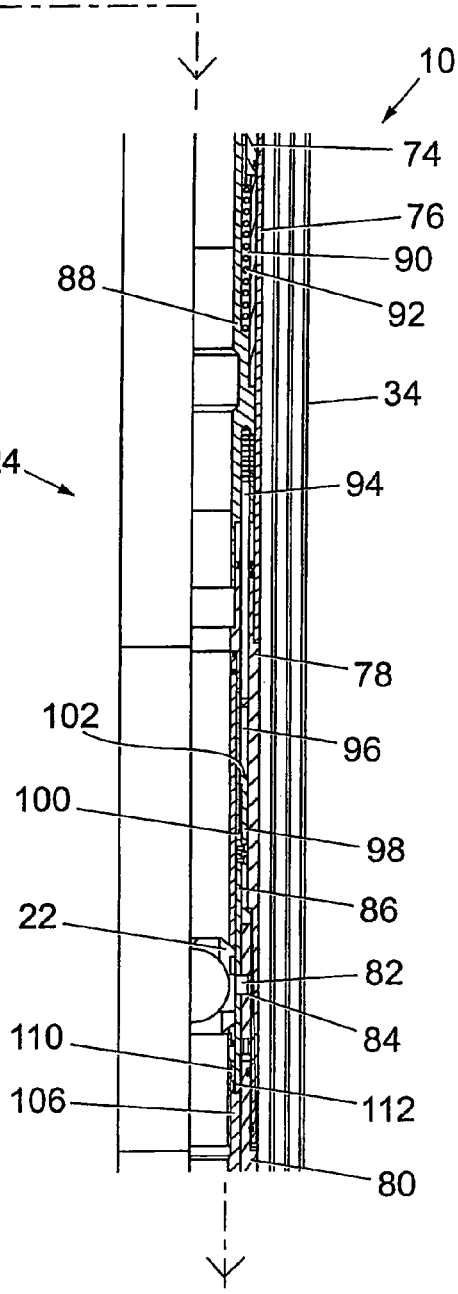
Figure 12:
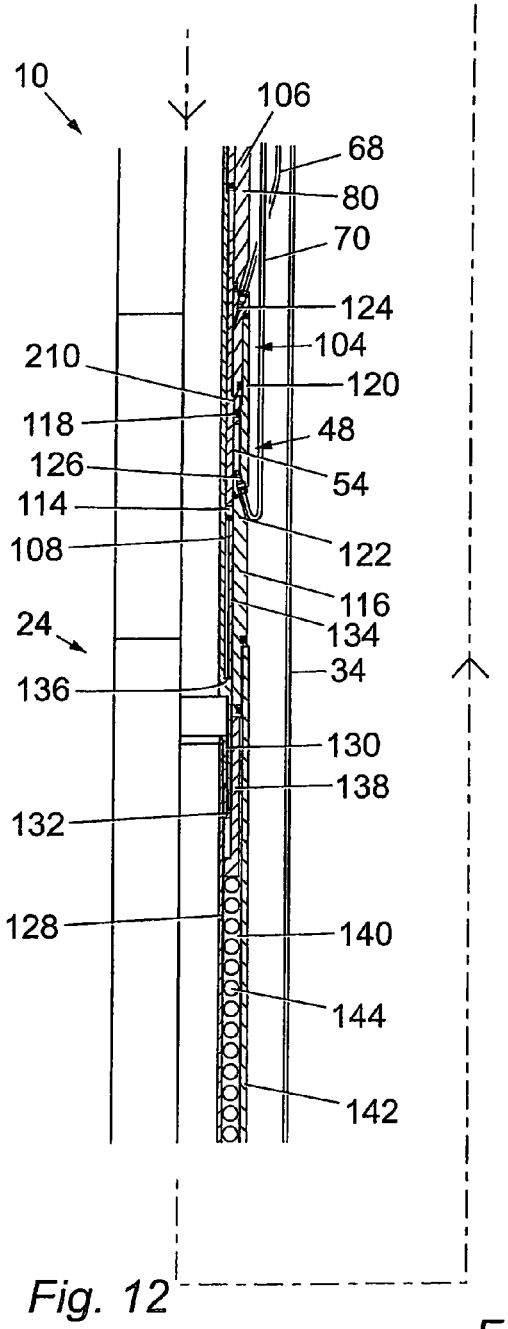
Figure 13:
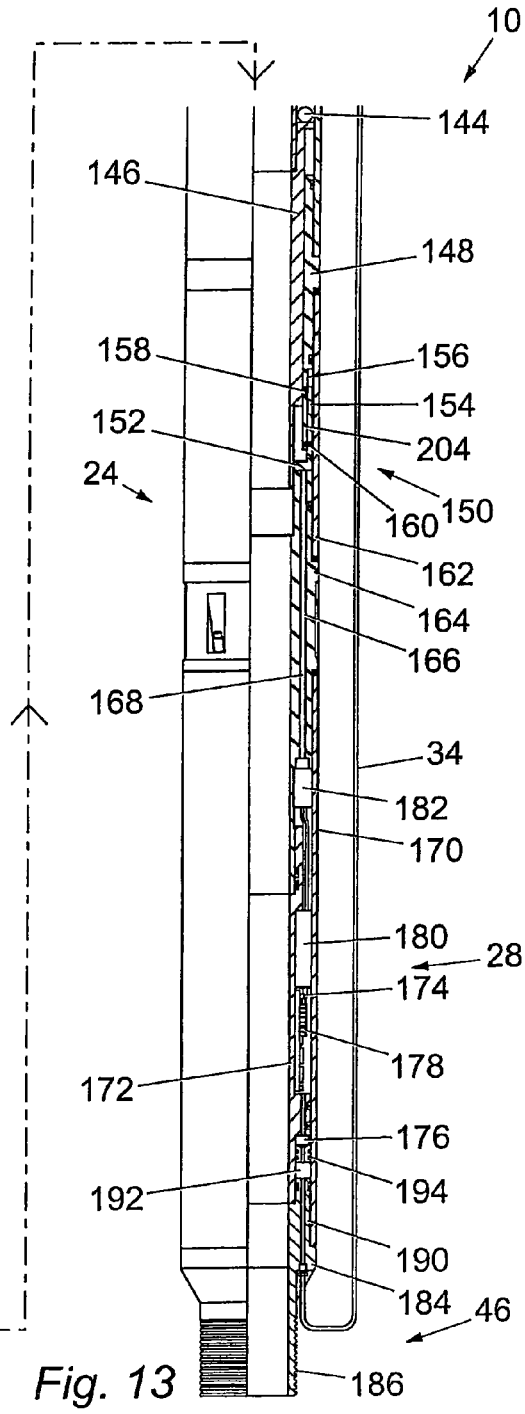
Figure 14:
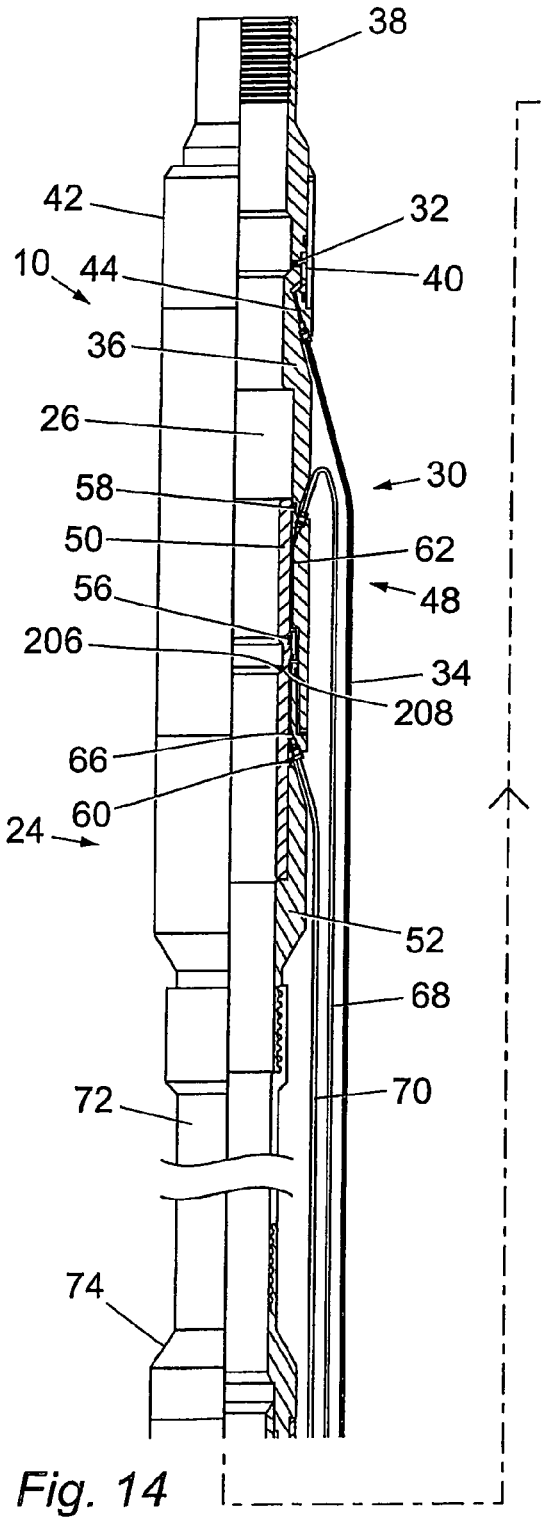
FIGS. 14 to 17 are views of the downhole valve assembly of FIGS. 2 to 5 following reopening of the valve using a primary valve actuation mechanism of the assembly.

The actuation mechanism 28 in fact forms a primary actuation mechanism, and the assembly 10 includes a secondary actuation mechanism 48. Secondary actuation mechanism 48 includes an operating member in the form of a sliding sleeve 50 which is mounted for sliding movement within the upper sub 36 and an intermediate sub 52 which is coupled to the upper sub 36. The secondary actuation mechanism 48 also includes a fluid actuated override member in the form of an annular override piston 54, which is shown in FIG. 4 and will be described below. The sliding sleeve 50 carries an O-ring 56 in a shoulder 208 thereof and, by virtue of further O-rings 58 and 60, is sealed within the upper sub 36 and the intermediate sub 52. An annular chamber 62 is defined between an outer surface of the sliding sleeve 50 and inner surfaces of the upper sub 36 and the intermediate sub 52. A flow passage 64 extends through a wall of the upper sub 36 and a similar flow path 66 through a wall of the intermediate sub 52, these flow passages 64, 66 opening on to the annular chamber 62. A control line 68 extends from the flow passage 64 and a control line 70 from the passage 66, thereby permitting fluid communication between the sliding sleeve 50 and the override piston 54, as will be described below. In the run-in configuration shown in FIGS. 2 to 5, the sliding sleeve 50 is in a first rest position.

The intermediate sub 52 is connected via a pup joint 72 to a further intermediate sub 74, to which a body section 76 is coupled. A further body section 78 is in-turn coupled to the body section 76 and a valve mounting section 80 is coupled to the body section 78. The ball valve 22 includes trunnions, one of which is shown and given the reference numeral 82, by which the ball valve 22 is rotatably mounted to the valve mounting section 80, the trunnions 82 located in apertures 84 in the valve mounting section. As the valve mounting section 80 is coupled to the second body section 78, the ball valve 22 is effectively held against axial movement relative to the body 24.

The ball valve 22 is located within a ball cage 86 which is itself mounted for sliding movement within the valve mounting section 80 and which, as will be described below, serves for moving the ball valve 22 between the open and closed positions. A ball sleeve 88 is mounted for sliding movement within and relative to the intermediate sub 74 and body section 76, and defines an annular spring chamber 90 between an outer surface of the ball sleeve 88 and an inner surface of the body section 76, in which a spring 92 is located. The spring 92 serves for biasing the ball sleeve 88 in a direction towards the ball valve 22. The ball sleeve 88 is connected via a rod 94 and coupling sleeve 96 to an upper cage sleeve 98, which is secured to the ball cage 86. Lips 100, 102 on the coupling sleeve 96 and upper cage sleeve 98 provide for a degree of axial movement of the ball sleeve 88 relative to the ball cage 86, and the lips 100, 102 are shown in FIG. 3 in abutment, whereupon a force exerted on the ball sleeve 88 in an uphole direction will transmit a force to the ball valve 22, as will be described below.

Below the ball valve 22, the ball cage 86 is connected to a coupling member 104 which forms part of the primary actuation mechanism 28. The coupling member 104 includes an upper sleeve 106 which is secured to a main tubular section 108, the upper sleeve 106 including a lip 110 which cooperates with and engages a lip 112 on a lower end of the ball cage 86. Engagement between the lips 110, 112 permits a force to be exerted on the ball cage 86 in a downhole direction, to move the ball valve 82 from a closed position to the open position, as will be described below. An annular chamber 114 is defined between an outer surface of the main tubular section 108 and inner surfaces of the valve mounting section 80 and an intermediate sub 116 which is coupled to the valve mounting section 80. The override piston 54 is located in the chamber 114 and carries an O-ring 118 on a shoulder 210 for sealing the override piston to the intermediate sub 116. Additionally, O-rings 120 and 122 are provided in the valve mounting section 80 and the intermediate sub 116. Passages 124, 126 extend through walls of the valve mounting section 80 and the intermediate sub 116, respectively, and are coupled to the control lines 68 and 70. Accordingly, the passage 64 opening on to chamber 62 is in fluid communication with the annular chamber 114 through the passage 124. In a similar fashion, the passage 66 opening on to annular chamber 62 is in fluid communication with the annular chamber 114 via the passage 126. Accordingly, and as will be described in more detail below, movement of the sliding sleeve 50 can effect a corresponding movement of the override piston 54. In the configuration of the valve assembly 10 shown in FIGS. 2 to 5, the override piston 54 is in a first rest position.

The coupling member 104 also includes a lower tubular section 128 which is threaded to a short sleeve 130, whilst the main tubular section 108 carries a similar short sleeve 132. As shown particularly in FIG. 4, these short sleeves 130, 132 are arranged to permit a limited axial movement of the main tubular section 108 relative to the lower tubular section 128. An abutment sleeve 134 is provided in the annular chamber 114 below the override piston 54, and is seated on a shoulder 136 of the main tubular section 108. Also, a spring sleeve 138 is located below and in abutment with the intermediate sub 116, in a spring chamber 140 defined between the main and lower tubular sections 108, 128 of the coupling member 104 and an outer tubular section 142. A spring 144 is located in the chamber 140, and the coupling member 104 includes a lower sleeve 146 which is coupled to the lower tubular section 128, against which the spring 144 acts.

The outer tubular section 142 of the body 24 is coupled to a lock sub 148, which forms part of a locking arrangement 150 of the assembly 10. The locking arrangement 150 includes a lock member in the form of a lock sleeve 152, which serves for locking the lower sleeve 146 (and thus the ball cage 86) against movement relative to the lock sub 148, and thus for locking the ball valve 22 against rotation relative to the body 24. The locking arrangement 150 also includes a number of locking dogs, one of which is shown and given the reference numeral 154, the locking dogs located in apertures 156 extending through a wall of the lock sub 148. In the position shown in FIG. 5, the locking dogs 154 extend from the apertures 156 and into a recess 158 in an outer surface of the lower sleeve 146 of the coupling member 104, and are held in this position by the lock sleeve 152. The lock sleeve 152 is itself initially secured relative to the lock sub 148 by a shear pin 160.

A body sleeve 162 couples the lock sub 148 to an intermediate sub 164 which includes a number of axial passages extending therethrough, one of which is shown and given the reference numeral 166. Release members of the locking arrangement 150, in the form of release rods 168, are mounted in the passages 166 for sliding movement relative to the intermediate sub 164. The release rods 168 serve for transmitting a force to the lock sleeve 152, to selectively release the lower sleeve 146 of the coupling member 104 for movement relative to the body 24.

An outer sleeve 170 of the primary actuation mechanism 28 is coupled to the intermediate sub 164 and, together with an inner sleeve 172, defines a chamber 174 in which further components of the actuation mechanism 28 are located. Following the teachings of WO 2007/049046, the primary actuation mechanism 28 includes a pressure transducer 176, control circuitry 178 and power cells 180. These, together with a number of pyrotechnic charges, one of which is shown and given the reference numeral 182, are located within and sealed in the chamber 174. Finally, at a lower end of the valve assembly 10, the body 24 includes a lower sub 184 which carries a male (pin) connector 186 for coupling to downhole tubing 188 (FIG. 1). The lower sub 184 includes a passage 190 in fluid communication with the primary control line 34 and which opens on to a chamber 192 in which the pressure transducer 176 is mounted in a floating piston 194.

The method of operation of the valve assembly 10 will now be described in more detail.

The valve assembly 10 is run-in to the wellbore 12 with the ball valve 22 in the open position shown in FIGS. 2 to 5. A wash-pipe (not shown) is then run-in and located within the valve assembly 10 and a wash-pipe collet 196 coupled to the ball sleeve 88, collet fingers 198 engaging in a recess 200 of the ball sleeve 88, as shown in FIGS. 6 to 9 and in particular in FIG. 7. Engagement of the collet fingers 198 in the recess 200 permits a force to be exerted on the ball sleeve 88 in an uphole direction, carrying the ball sleeve 88 upwardly and compressing the spring 92. The connection between the ball sleeve 88 and the coupling sleeve 96 (via the rod 94) carries the coupling sleeve 96 upwardly with the ball sleeve 88. In a similar fashion, engagement between the lip 100 on coupling sleeve 96 and the lip 102 on the upper cage sleeve 98 carries the ball cage 86 upwardly relative to the body 24. This upward movement of the ball cage 86 rotates the ball valve 22 about the trunnions 82, moving the ball valve to the closed position shown in FIG. 7. In this position, a bore 202 of the ball valve 22 is disposed perpendicular to the main fluid flow path 26 extending through the body 24. The flow path 26 is thus now closed and the portion of the wellbore 12 below the ball valve 22 is closed and sealed relative to the portion above the valve.

As the ball cage 86 moves upwardly, engagement between the lip 110 on the upper sleeve 106 of coupling member 104, and the lip 112 on the ball cage 86 carries the upper sleeve 106, main tubular section 108 and short sleeve 132 upwardly. Thus closes the distance between the short sleeves 130, 132 on the lower tubular section 128 and main tubular section 108. However, the lower tubular section 128 remains restrained against movement by virtue of its connection with the lower sleeve 146, which remains fixed relative to the body 24 by the locking dogs 154.

The collet 196 can then be snapped-out of engagement with the ball sleeve 88 and returned to surface, whereupon the valve assembly 10 moves to the configuration shown in FIGS. 10 to 13. Following release of the collet 196, the spring 92 acts upon the ball sleeve 88 to return it down to the position shown in FIG. 3, this movement carrying the coupling sleeve 96. However, the force is not transmitted to the ball cage 86 as the lips 100 and 102 on the coupling sleeve 96 and upper cage sleeve 98 separate and move apart. Accordingly, the ball cage 86 is maintained in the position where the ball valve 22 is closed. Following closure of the ball valve 22 in this fashion, a pressure test operation may be carried out, as described above.

Following completion of the pressure test, when it is desired to reopen valve assembly 10, the primary actuation mechanism 28 is actuated, as will now be described with reference to FIGS. 14 to 17. In the illustrated embodiment, the primary valve actuation mechanism 28 is activated by increasing the pressure in the casing 14 above the closed ball valve 22 to a level which is within a predetermined pressure window. This fluid pressure is communicated to the primary actuation mechanism 28 through the inlet port 32, chamber 40, passage 44 and the primary control line 34. As described above, control line 34 communicates with the chamber 192 through the passage 190, and thus the floating piston 194 carrying the pressure transducer 176 is exposed to fluid at a pressure equivalent to that present in the casing 14 above the closed ball valve 22.

The pressure is maintained within the predetermined pressure window for a specified period of time. When this occurs, pressure readings transmitted to the control circuitry 178 by the transducer 176 cause the circuitry to generate an output signal which ignites the pyrotechnic charges 182. When the charges 182 are fired, the release rods 168 are urged rapidly upwardly, thereby exerting a force on the lock sleeve 152. This shears the pins 160, releasing the lock sleeve 152 and carrying the lock sleeve a short distance uphole. The locking dogs 150 are now located adjacent a recess 204 in an inner surface of the lock sleeve 152. The spring 144 then urges the lower sleeve 146 of the coupling member 104 downwardly, interengagement between the recess 158 and tapered surfaces on the locking dogs 154 urging the dogs radially outwardly.

Figure 15:
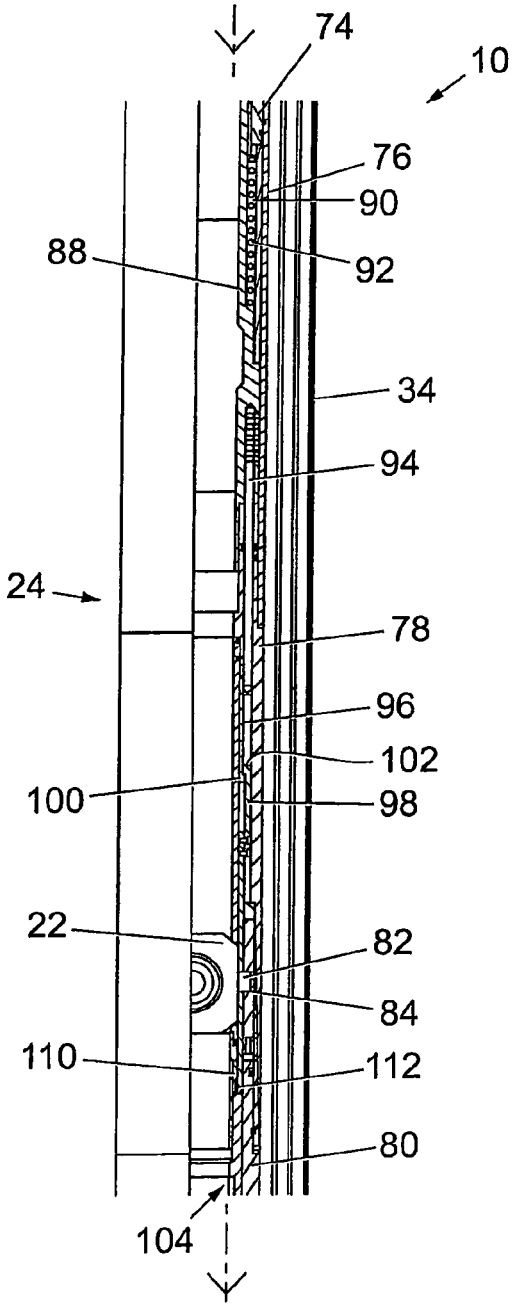
Figure 16:
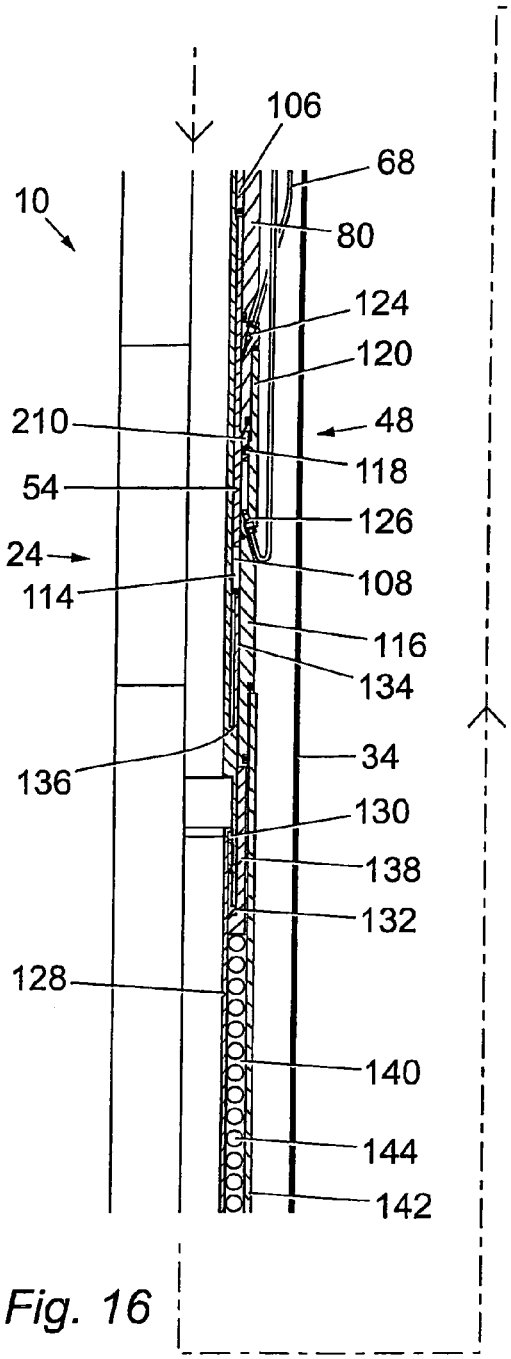
Figure 17:
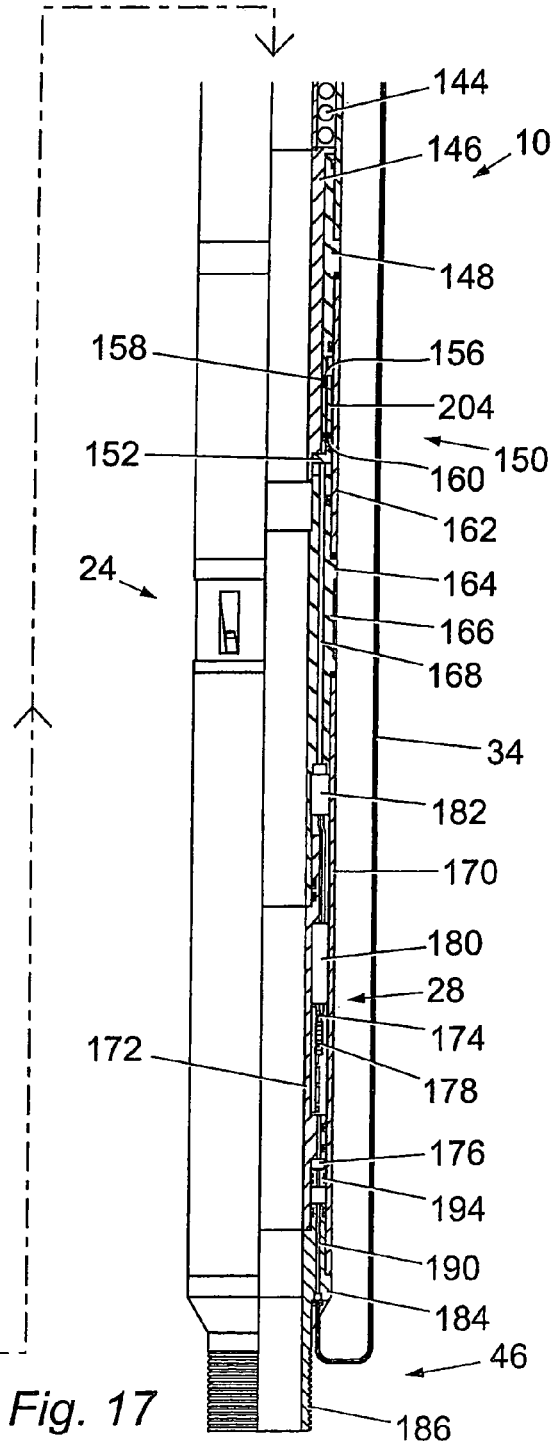
Figure 18:
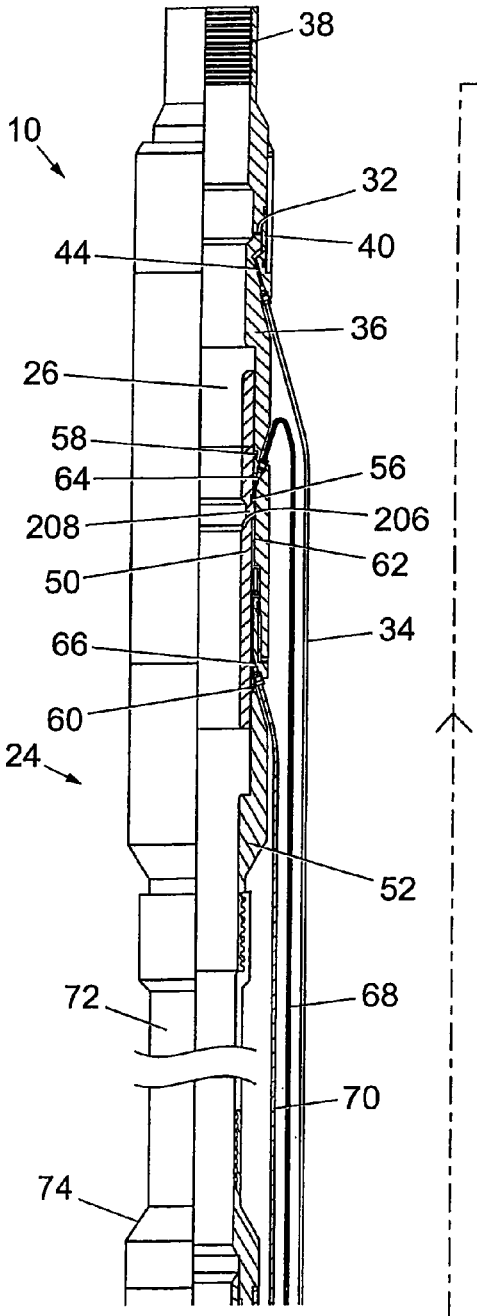
FIGS. 18 to 21 are views of the valve assembly of FIGS. 2 to 5 following reopening of the valve using a secondary valve actuation mechanism of the assembly.
Figure 19:
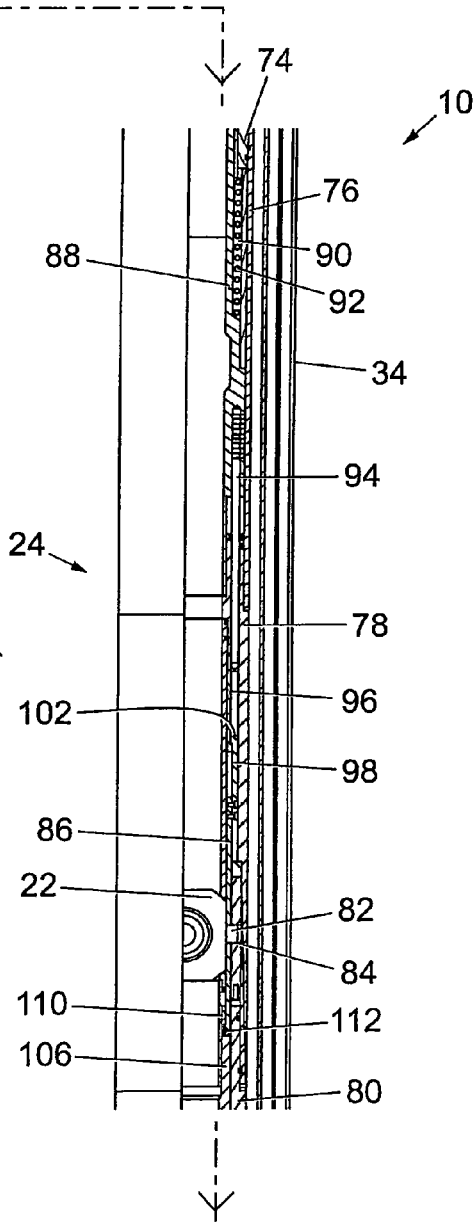
Figures 20, 21:
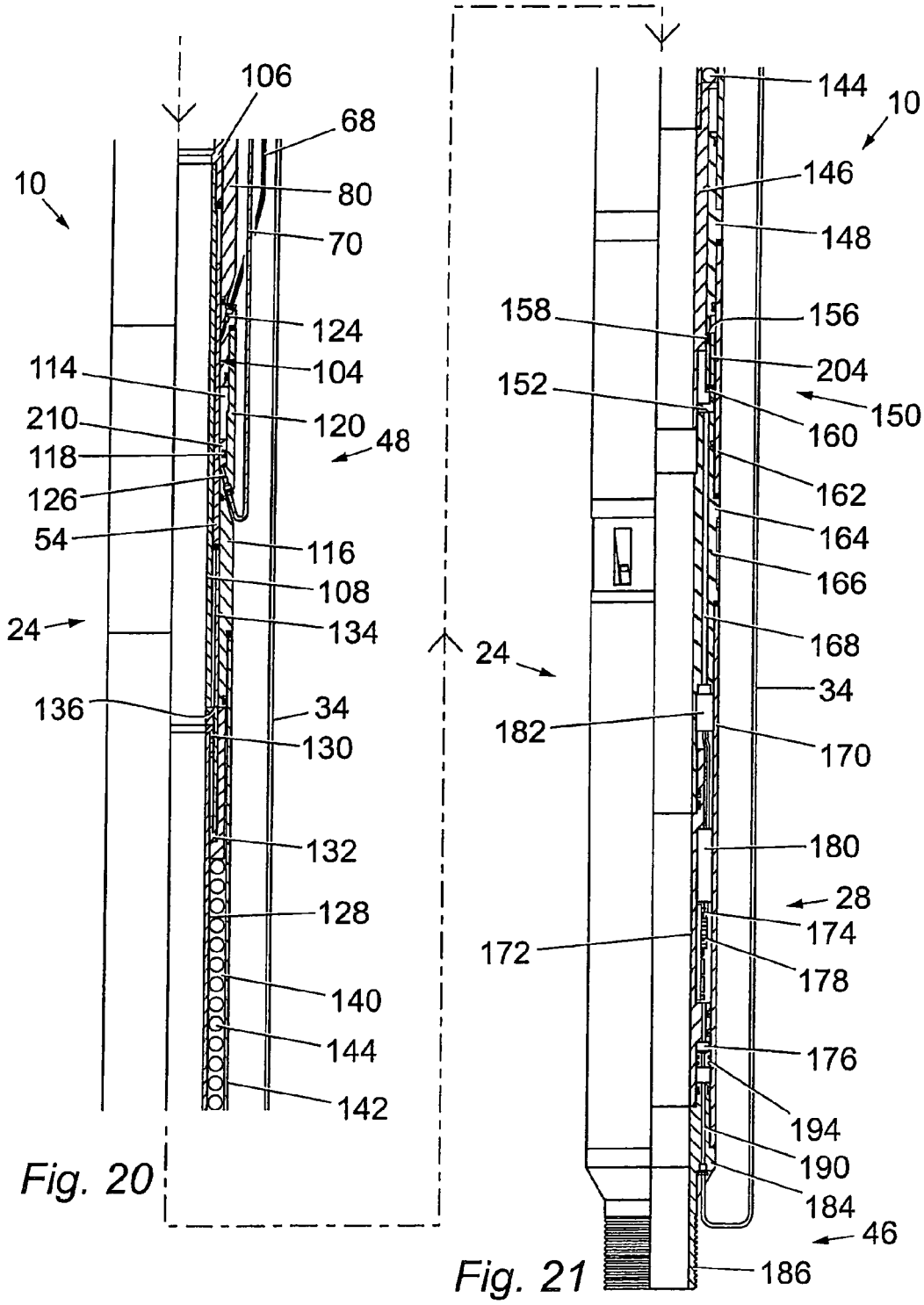

As the lower sleeve 146 moves down, carrying the lower tubular section 128, the short sleeve 130 on the tubular section 128 is brought into abutment with the short sleeve 132 mounted on the main tubular section 108 of the coupling member 104. Thus, as the lower sleeve 146 continues to move down, the upper sleeve 106 of coupling member 104 is also carried down. Engagement between the lip 110 on upper sleeve 106 and the lip 112 on the ball cage 86 moves the ball cage down, this rotating the ball valve 22 back to the open position, as shown in FIG. 15. In the event, however, that the primary actuation mechanism 28 fails to return the ball valve 22 to the open position, the secondary actuation mechanism 48 may be utilised to open the ball valve, as will now be described with reference to FIGS. 18 to 21.

The valve assembly 10 is shown in FIGS. 18 to 21 following an attempt to open the ball valve 22 using the primary actuation mechanism 28. Failure of the primary actuation mechanism 28 has resulted in the locking arrangement 150 being held in the configuration shown in FIGS. 2 to 5, and thus with the locking dogs 154 holding the lower sleeve 146 of coupling member 104 against movement relative to the body 24. To open the ball valve 12, a stinger or other like tool (not shown) is run in and collet fingers on the stinger latched into a recess 206 in the sliding sleeve 50. A pull force can then be exerted on the sliding sleeve 50, carrying the sleeve upwardly to a second rest position shown in FIG. 18. This movement of the sliding sleeve 50 pumps fluid out of the flow passage 64, along control line 68 and into the chamber 114 in which the override piston 54 is located, the fluid entering through the passage 124. This causes the override piston 54 to move downwardly to ascend rest position, expelling fluid from the chamber 114 through the passage 126, back along control line 70 and into the annular chamber 62 in which the sliding sleeve 50 is located through the other passage 66.

Downward movement of the override piston 54 brings the piston into abutment with the abutment sleeve 134, and continued downward movement thus transmits a force to the main tubular section 108. As described above, engagement of the lips 110, 112 of the upper sleeve 106 of coupling member 104 and ball cage 86 then moves the ball cage down, rotating the ball valve 22 to the open position. This downward movement of the sliding sleeve 50 continues until such time as shoulders 208 and 210 on the sliding sleeve 50 and override piston 54, respectively, butt-out. It will be understood that, by this mechanism, the ball valve 22, and thus the valve assembly 10, may be reopened even in the event of failure of the primary actuation mechanism 28.

Figure 22:
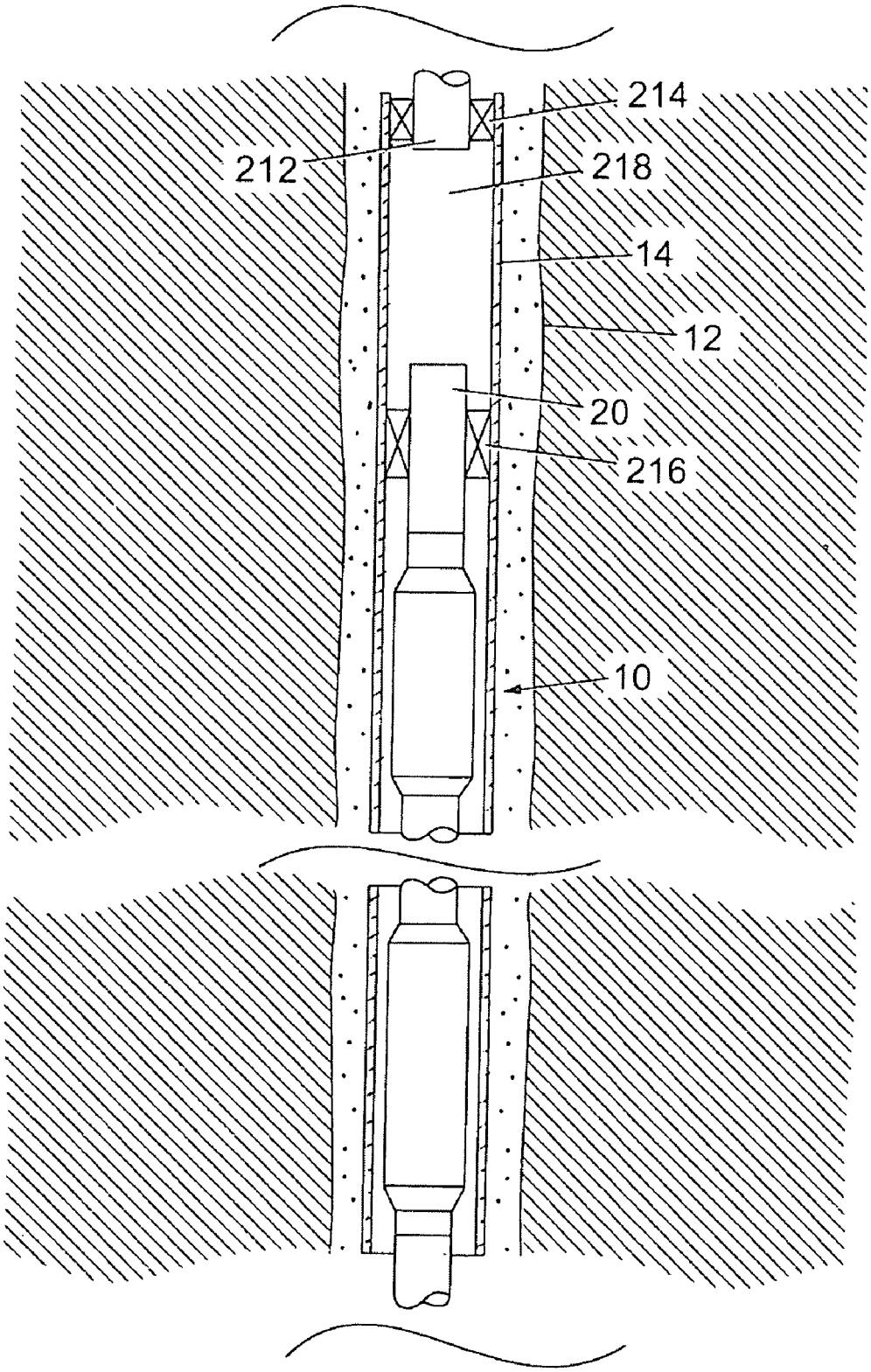
FIG. 22 is a schematic, partial longitudinal sectional view of the valve assembly of FIG. 1 shown located in a wellbore and with production tubing located in the wellbore above and spaced from the valve assembly.

Turning now to FIG. 22, there is shown a view of the valve assembly 10 located in the wellbore 12 in a similar fashion to that shown and described above with reference to FIG. 1. However, instead of coupling a production tubing to the hanger/packer tool assembly 20 following pressure testing of the casing 14, a production tubing 212 is located within the casing 14 using a packer 214. The packer 214, together with a packer 216 of the hanger/packer tool assembly 20, together isolate a portion 218 of the wellbore 12, fluid communication between the valve assembly 10 and the production tubing 212 being achieved through the isolated section 218.

Figure 23:
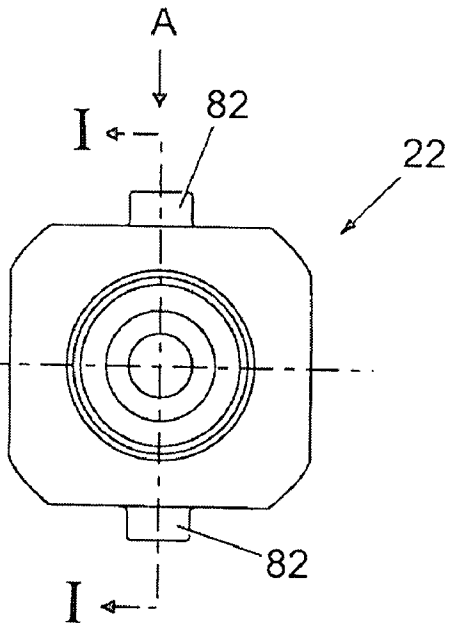
FIG. 23 is an enlarged view of the valve of the valve assembly shown in FIGS. 2 to 5.
Figure 25:
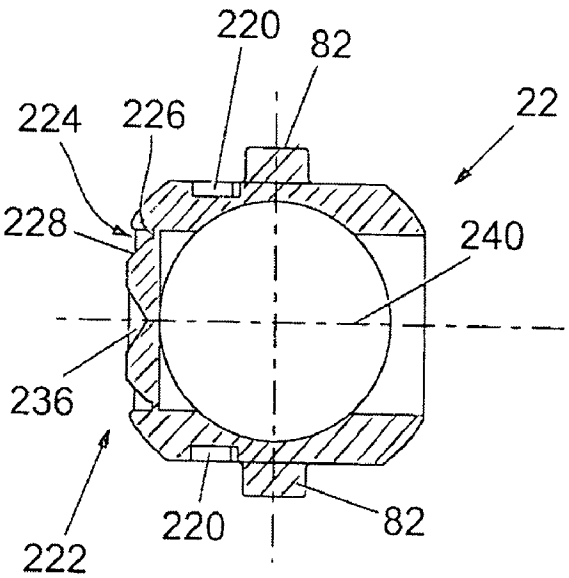
FIG. 25 is a cross-sectional view of the valve of the valve assembly of FIGS. 2 to 5 taken about the line I-I of FIG. 23.
Figure 24:
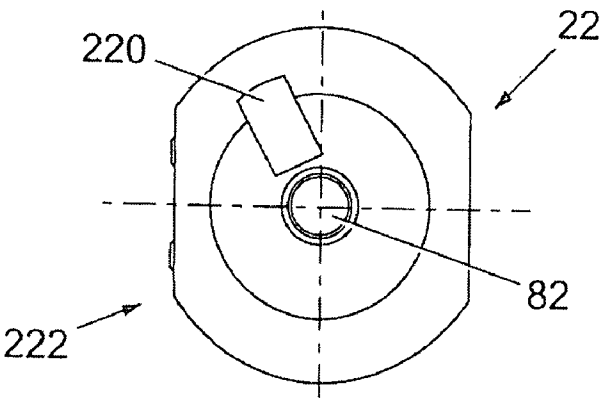
FIG. 24 is a view of the valve of the valve assembly of FIGS. 2 to 5 taken in the direction of the arrow A in FIG. 23 and rotated through 90°.

Turning now to FIG. 23, the ball valve 22 itself is shown in more detail. The ball valve is also shown in the view of FIG. 24, which is taken in the direction of the arrow A of FIG. 23 (rotated through 90.degree.), and in the view of FIG. 25, which is a cross-sectional view taken about the line I-I of FIG. 23.

The ball valve 22 includes recesses 220, each of which are shaped to received dogs (not shown) on the ball cage 86, which serve for rotating the ball valve 22 about the trunnions 82, in a fashion known in the art.

Figure 26:
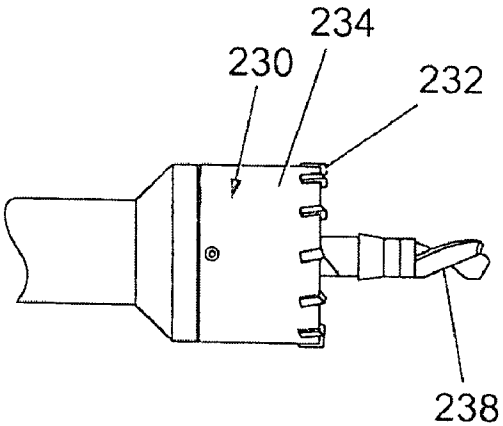
FIG. 26 is a view of a cutting tool used to cut out a portion of the valve of the valve assembly of FIGS. 2 to 5 in the event that the valve becomes stuck in a closed position.

Additionally, the ball valve 22 includes a surface 222 which includes a circular recess 224. A wall thickness of the ball valve 22 in the region of a root or base 226 of the recess 224 is smaller than adjacent portions of the ball valve. Furthermore, the recess 224 includes an inclined surface 228 which serves for guiding a cutting tool in the form of a milling tool 230, shown in FIG. 26, into engagement with the ball valve 22. In particular, the inclined surface 228 serves for guiding cutting teeth provided on an annular body 234 of the milling tool 230 into the recess 224, for cutting through the wall of the ball valve in the thinnest region adjacent the base 226 of the recess 224.

The surface 222 additionally includes a further, cone-shaped recess 236 which is shaped for receiving a drill bit extension 238 of the milling tool 230, which serves primarily for centring the milling tool 230 relative to an axis 240 of the ball valve 222.

If desired, the circular recess 224 and the cone-shaped recess 236 may be filled with a material of a lower hardness than a remainder of the ball valve 22, such as a softer metal, an elastomeric or a plastics material. Such materials may be relatively easy to mill or cut away, but may prevent the recesses 224, 236 from becoming blocked with solids deposits.

The ball valve 22 is shaped to include the recesses 224 and 236 to facilitate milling/cutting of the ball valve 22 in the event that the ball valve should for any reason become stuck in the closed position.

Various modifications may be made to the foregoing without departing from the spirit and scope of the present invention.

For example, although a valve assembly has been described which has a particular utility in downhole environments, it will be understood that the assembly (and the associated actuation device) of the present invention has a utility in other environments, and thus with or in other types of tools or tubing, such as pipelines or flowlines.

Although the above-described embodiments of the invention incorporate a valve in the form of a ball valve, it will be understood that other types of valves may be utilised, including flapper valves.

Although the primary actuation mechanism is described above as moving the valve from a closed to an open position, it will be understood that the valve assembly may be configured such that the primary actuation mechanism is utilised to move the valve from an open to a closed position. In this event and with the valve in an open position, pressure applied to the actuation mechanism through the fluid communication arrangement may be also be transmitted to producing and/or other formations downhole of the ball valve. It will be understood that the secondary actuation mechanism may similarly be configured to move the valve from an open to a closed position.

It will be understood that references herein to components of the valve assembly of the present invention being uphole, relative to a defined reference point, are to be construed as meaning further along a wellbore in a direction towards the surface (and thus to a position which is shallower in the wellbore). Equally, references herein to components of the valve assembly being downhole, relative to a defined reference point, are to be construed as meaning further along a wellbore in a direction away from the surface (and thus to a position which is deeper in the wellbore).

The invention claimed is:

1. A downhole valve assembly comprising:

a generally tubular body defining a fluid flow path therethrough;

a ball valve mounted within the body, the valve movable between an open position and a closed position for thereby controlling the flow of fluid along the fluid flow path;

a valve actuation mechanism mounted within the body, the actuation mechanism located in a position which is, in use, downhole of the valve; and a fluid communication arrangement for communicating wellbore fluid pressure to the valve actuation mechanism to facilitate operation of the valve actuation mechanism and thereby operation of the valve, the fluid communication arrangement comprising a fluid inlet port which is, in use, located uphole of the valve;

wherein the valve actuation mechanism takes the form of a primary valve actuation mechanism, and the assembly further comprises a secondary valve actuation mechanism, wherein the secondary actuation mechanism comprises a fluid actuated override member, which takes the form of an override piston, wherein the override member is adapted to exert a force on a coupling member of the primary actuation mechanism, to move the valve, wherein the secondary actuation mechanism further comprises an operating member taking the form of a sliding sleeve located, in use, uphole of the valve and which is fluidly coupled to the override member and controls movement of the override member, wherein the sleeve is mounted for movement within the body and whereby movement of the sleeve pumps fluid to the override member such that the valve is moved.

2. A downhole valve assembly according to claim 1 wherein the actuation mechanism comprises a force transmission arrangement having an actuating member and the coupling member, the actuating member connected to the coupling member and the coupling member connected to the valve, to facilitate transmission of a force from the actuating member to the valve.

3. A downhole valve assembly according to claim 2 wherein the actuating member is connected to the coupling member via a connector which facilitates limited axial movement of the coupling member relative to the actuating member in a direction towards the valve.

4. A downhole valve assembly according to claim 2 wherein the actuating member is selectively restrained against axial movement relative to the body by a locking arrangement and, when the locking arrangement is actuated, is released for movement under a biasing force in the direction away from the valve.

5. A downhole valve assembly according to claim 4 wherein the locking arrangement comprises an at least one lock member adapted to restrain the actuating member against movement relative to the body, and at least one release member adapted to exert a release force on an or each lock member, to cause the or each lock member to release the actuating member for movement relative to the body.

6. A downhole valve assembly according to claim 5 wherein the locking arrangement further comprises an at least one locking dog, the or each dog movable from a release position out of engagement with the actuating member to a locking position in engagement with the actuating member, for restraining the actuating member against movement relative to the body.

7. A downhole valve assembly according to claim 1 wherein the actuation mechanism includes a pressure sensor for measuring pressure in a wellbore in which the assembly is located, and means for setting a reference pressure value using a measurement obtained by the pressure sensor.

8. A downhole valve assembly according to claim 1 wherein the ball valve is secured against axial movement relative to the body and comprises trunnions for mounting the ball valve to the body, the trunnions extending through a ball cage, the ball cage adapted to co-operate with the ball valve for rotating the ball valve between the open and closed positions.

9. A downhole valve assembly according to claim 8 wherein the ball valve comprises a surface defining at least one recess therein, the recess adapted to define a guide for guiding a cutting tool into contact with the ball valve, a wall thickness of the ball valve in a region adjacent a base or root of the recess being smaller than a wall thickness of the ball valve laterally spaced from the base.

10. A downhole valve assembly according to claim 9 wherein the recess is circular, and at least one side wall of the recess is inclined relative to an axis of the ball valve which is parallel to a main axis of the body when the ball valve is in the closed position.

11. A downhole valve assembly according to claim 9 wherein the recess of the ball valve is at least partly filled with a material having a lower hardness in comparison to a material of a main part of the ball valve.

12. A downhole valve assembly according to claim 1, wherein the sleeve is adapted to be moved by operation of a downhole tool that is run into the assembly and engaged with the operating member.

13. A downhole valve assembly comprising:

a generally tubular body defining a fluid flow path therethrough;

a ball valve mounted within the body, the valve movable between an open position and a closed position for thereby controlling the flow of fluid along the fluid flow path;

a valve actuation mechanism mounted within the body, the actuation mechanism located in a position which is, in use, downhole of the valve;

a fluid communication arrangement for communicating wellbore fluid pressure to the valve actuation mechanism to facilitate operation of the valve actuation mechanism and thereby operation of the valve, the fluid communication arrangement comprising a fluid inlet port which is, in use, located uphole of the valve; and wherein the ball valve is secured against axial movement relative to the body and comprises trunnions for mounting the ball valve to the body, the trunnions extending through a ball cage, the ball cage adapted to co-operate with the ball valve for rotating the ball valve between the open and closed positions;

the ball valve further comprising a surface defining at least one recess therein, the recess adapted to define a guide for guiding a cutting tool into contact with the ball valve, a wall thickness of the ball valve in a region adjacent a base or root of the recess being smaller than a wall thickness of the ball valve laterally spaced from the base; and the recess of the ball valve is at least partly filled with a material having a lower hardness in comparison to a material of a main part of the ball valve.

* * * * *